US008056768B2

(12) United States Patent
Snodgrass

(10) Patent No.: US 8,056,768 B2
(45) Date of Patent: Nov. 15, 2011

(54) FOAM PUMP ASSEMBLY

(76) Inventor: David L. Snodgrass, Stuart, FL (US)

( * ) Notice: Subject to any disclaimer, the term of this patent is extended or adjusted under 35 U.S.C. 154(b) by 898 days.

(21) Appl. No.: 12/005,756

(22) Filed: Dec. 28, 2007

(65) Prior Publication Data

US 2009/0166382 A1 Jul. 2, 2009

(51) Int. Cl.
*B67D 7/76* (2010.01)

(52) U.S. Cl. ..... 222/190; 222/321.7

(58) Field of Classification Search ..... 222/190, 222/145.6, 321.9, 321.7, 380, 382, 383.1
See application file for complete search history.

(56) References Cited

U.S. PATENT DOCUMENTS

| | | | | |
|---|---|---|---|---|
| 3,937,364 | A | 2/1976 | Wright | |
| 3,941,355 | A * | 3/1976 | Simpson | 366/99 |
| 4,018,364 | A | 4/1977 | Wright | |
| 4,074,363 | A * | 2/1978 | Croft | 366/138 |
| 4,349,131 | A | 9/1982 | Arabian | |
| 4,463,905 | A | 8/1984 | Stoesser et al. | |
| 4,477,000 | A | 10/1984 | Arabian | |
| 4,615,467 | A | 10/1986 | Grogan et al. | |
| 4,762,253 | A * | 8/1988 | Palmert | 222/145.2 |
| 4,880,161 | A | 11/1989 | Wright | |
| 4,932,567 | A | 6/1990 | Tanabe et al. | |
| 5,071,379 | A | 12/1991 | Poizot | |
| 5,219,102 | A | 6/1993 | Wright | |
| 5,271,530 | A | 12/1993 | Uehira et al. | |
| 5,282,552 | A | 2/1994 | Ophardt | |
| 5,289,952 | A | 3/1994 | Gueret | |
| 5,411,183 | A | 5/1995 | Hildebrandt | |
| 5,443,569 | A | 8/1995 | Uehira et al. | |
| 5,445,288 | A | 8/1995 | Banks | |
| 5,556,005 | A | 9/1996 | Banks | |
| 5,570,819 | A | 11/1996 | Uehira et al. | |
| 5,906,299 | A | 5/1999 | Hagleitner | |
| 6,053,364 | A | 4/2000 | Van Der Heijden | |
| 6,082,586 | A | 7/2000 | Banks | |
| 6,427,875 | B1 | 8/2002 | Hoang et al. | |
| 6,446,840 | B2 | 9/2002 | Ophardt et al. | |
| 6,536,629 | B2 | 3/2003 | Van Der Heijden | |
| 6,612,468 | B2 | 9/2003 | Pritchett et al. | |
| 6,644,516 | B1 | 11/2003 | Foster et al. | |
| 6,752,292 | B2 * | 6/2004 | Van Herpen | 222/137 |
| 6,808,091 | B2 * | 10/2004 | Njaastad | 222/459 |
| 6,840,408 | B1 | 1/2005 | Foster et al. | |
| 6,923,346 | B2 | 8/2005 | Foster et al. | |
| 7,004,356 | B1 | 2/2006 | Sayers et al. | |
| 7,048,153 | B2 | 5/2006 | Gentile | |
| 7,066,355 | B2 | 6/2006 | Lewis et al. | |
| 7,147,133 | B2 | 12/2006 | Brouwer et al. | |
| 7,278,554 | B2 | 10/2007 | Armstrong | |
| 2006/0151538 | A1 | 7/2006 | Van Der Heijden | |
| 2006/0157512 | A1 | 7/2006 | Van Der Heijden | |
| 2008/0093386 | A1 | 4/2008 | Arminak | |

* cited by examiner

*Primary Examiner* — Lien Ngo
(74) *Attorney, Agent, or Firm* — Lucas & Mercanti, LLP

(57) ABSTRACT

A foam pump assembly for dispensing foam comprises a dual piston pump engine having an air cylinder and fluid cylinder each with pistons, a mixing chamber in communication with the liquid cylinder for receiving liquid, and in communication with the air cylinder for receiving air, an outlet chamber providing a flow path with turns, whereby when air and fluid is fed into said mixing chamber foam is created which passes into the outlet chamber, through the flow path and out of the pump outlet.

20 Claims, 4 Drawing Sheets

FOAM PUMP ASSEMBLY

BACKGROUND OF THE INVENTION

The present invention relates to a foam pump assembly usable to make foam for use as personal care and/or hygiene products such as hand soap, moisturizers, sanitizers, shampoo, shower gels, and shaving cream, for example.

There are a number of commercial foam pumps and pump engines on the market today available from companies such as Arminak and Associates, Airspray, K&K, and others. Some patents relating to such foam pumps are U.S. Pat. Nos. 5,271,530; 5,443,569; 5,445,288; 6,053,364 and 6,082,586, all of which are incorporated by reference herein. Such foam pumps typically comprise a pump engine connected to a liquid container. The overall assembly typically has an air chamber with an air inlet and air outlet, a liquid chamber with a liquid inlet and liquid outlet, a mixing chamber, an actuator for working the pump so that air from the air chamber and liquid from the liquid chamber is fed to the mixing chamber to create foam. These pumps typically have a porous member in the form of a planar mesh or screen having a large number of pores.

The porous member is typically located after the mixing chamber and is asserted to help improve the foam characteristics in some way, possibly by helping to create the foam or to homogenize the foam to provide a relatively uniform air bubble size for the foam.

However, such a porous member can become at least partly clogged when the mixture oxidizes or dries out, especially when the pump is unused for an extended period. Although the mesh pore size may be different for different applications, the pore size is typically relatively small which tends to make the porous member more susceptible to clogging. The porous member may also be difficult to fabricate and may also make the pump more costly.

SUMMARY OF THE INVENTION

It is an object of the present invention to provide a foam pump assembly which provides a good foam product without any porous member.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber providing a flow path with successive turns, whereby when air and fluid is fed into said mixing chamber foam is created which passes into the outlet chamber, through the flow path and out of the pump outlet.

The invention also provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks contained in a cylinder to define a flow path with successive turns, whereby when air and fluid is fed into said mixing chamber foam is created which passes into the outlet chamber, through the flow path and out of the pump outlet.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks contained in a cylinder, wherein the edges of the disks have a reduced diameter along at least a portion of the circumference to define a flow path passage between the disk edge and a wall of the outlet chamber to define a flow path with successive turns, whereby when air and fluid is fed into said mixing chamber foam is created which passes into the outlet chamber, through the flow path and out of the pump outlet, wherein the edges of the disks have a reduced diameter along at least a portion of the circumference to define a flow path passage between the disk edge and a wall of the outlet chamber.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber providing a flow path with successive turns, wherein the outlet chamber comprises a plurality of stacked and spaced disks contained in a cylinder which define the flow path, wherein the edges of the disks have a reduced diameter along at least a portion of the circumference to define a flow path passage between the disk edge and a wall of the outlet chamber, wherein support members are provided between the disks to support and space the disks, wherein the support members comprise a pair of support chamber walls which cross each other, and wherein at least one end of one support chamber wall extends to a wall of the outlet chamber, whereby when air and fluid is fed into said mixing chamber foam is created which passes into the outlet chamber, through the flow path and out of the pump outlet. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a single orifice smaller than said mixing chamber cross sectional area, and at least one outlet chamber in communication with the mixing chamber through said one orifice outlet and in communication with a pump outlet for dispensing foam, whereby when air and fluid is fed into said mixing chamber foam is created which passes through the orifice outlet, through the outlet chamber and out of the pump outlet.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a single orifice in the shape of a slit smaller than said mixing chamber cross sectional area, and at least one outlet chamber in communication with the mixing chamber through said one orifice outlet and in communication with a pump outlet for dispensing foam, whereby when air and fluid is fed into said mixing chamber foam is created which passes through the orifice outlet, through the outlet chamber and out of the pump outlet.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a plurality of successive orifice plates each defining at least one orifice smaller than said mixing chamber cross sectional area, and a plurality of successive outlet chambers between the mixing chamber and a pump outlet for dispensing foam, whereby when air and fluid is fed into said mixing chamber foam is created which passes through the orifices and outlet chambers and out of the pump outlet.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a plurality of successive orifice plates each defining an elongated slit smaller than said mixing chamber cross sectional area, the orifice plates being oriented along the flow path so that the elongated slits are rotated relative to each other in the flow direction of the foam, and a plurality of successive outlet chambers between the mixing chamber and a pump outlet for dispensing foam, whereby when air and fluid is fed into said mixing chamber foam is created which passes through the orifices and outlet chambers and out of the pump outlet.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of sub-chambers connected in series to provide a series flow path for the foam, and defining restricted passageways between the adjacent sub-chambers, whereby when air and fluid is fed into said mixing chamber foam is created which passes into the outlet chamber, through the flow path and out of the pump outlet.

The present invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber providing a flow path with turns, whereby when air and fluid is fed into said mixing chamber foam is created which passes into the outlet chamber, through the flow path and out of the pump outlet.

DESCRIPTION OF THE PREFERRED EMBODIMENT

Figure 1:
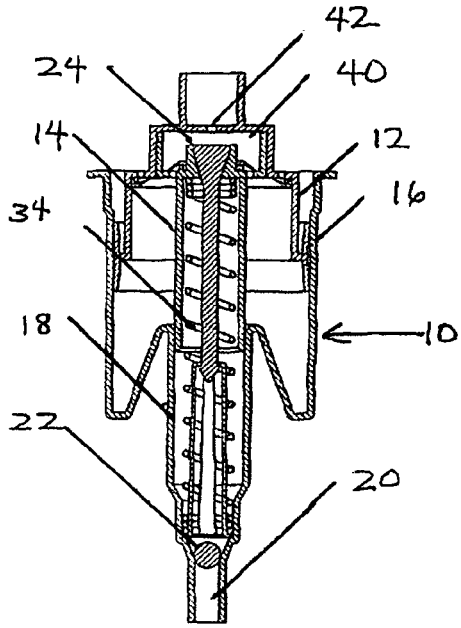
FIG. 1 is an elevation view, in cross section, of a foam pump assembly and outlet chamber according to one embodiment of the invention.

A preferred exemplary embodiment of the invention will now be described, but the invention is not limited to this embodiment.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber providing a flow path with successive turns, whereby when air and fluid is fed into said mixing chamber foam is created which passes into the outlet chamber, through the flow path and out of the pump outlet.

The outlet chamber may comprise a plurality of stacked and spaced disks contained in a cylinder which define the flow path. The edges of the disks may have a reduced diameter along at least a portion of the circumference to define a flow path passage between the disk edge and a wall of the outlet chamber. The pump assembly may further comprise support members between the disks to support and space the disks. The support members may comprise a pair of support chamber walls which cross each other, and wherein at least one end of one support chamber wall extends to a wall of the outlet chamber. The foam pump assembly may further comprise a container for holding a source of liquid.

The invention also provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks contained in a cylinder to define a flow path with successive turns, whereby when air and fluid is fed into said mixing chamber foam is created which passes into the outlet chamber, through the flow path and out of the pump outlet.

The edges of the disks may have a reduced diameter along at least a portion of the circumference to define a flow path passage between the disk edge and a wall of the outlet chamber. The foam pump assembly may further comprise support members between the disks to support and space the disks. The support members may comprise a pair of support chamber walls which cross each other, and wherein at least one end of one support chamber wall extends to a wall of the outlet chamber. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks contained in a cylinder, wherein the edges of the disks have a reduced diameter along at least a portion of the circumference to define a flow path passage between the disk edge and a wall of the outlet chamber to define a flow path with successive turns, whereby when air and fluid is fed into said mixing chamber foam is created which passes into the outlet chamber, through the flow path and out of the pump outlet, wherein the edges of the disks have a reduced diameter along at least a portion of the circumference to define a flow path passage between the disk edge and a wall of the outlet chamber.

The foam pump assembly may further comprise support members between the disks to support and space the disks. The support members may comprise a pair of support chamber walls which cross each other, and wherein at least one end of one support chamber wall extends to a wall of the outlet chamber. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber providing a flow path with successive turns, wherein the outlet chamber comprises a plurality of stacked and spaced disks contained in a cylinder which define the flow path, wherein the edges of the disks have a reduced diameter along at least a portion of the circumference to define a flow path passage between the disk edge and a wall of the outlet chamber, wherein support members are provided between the disks to support and space the disks, wherein the support members comprise a pair of support chamber walls which cross each other, and wherein at least one end of one support chamber wall extends to a wall of the outlet chamber, whereby when air and fluid is fed into said mixing chamber foam is created which passes into the outlet chamber, through the flow path and out of the pump outlet. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a single orifice smaller than said mixing chamber cross sectional area, and at least one outlet chamber in communication with the mixing chamber through said one orifice outlet and in communication with a pump outlet for dispensing foam, whereby when air and fluid is fed into said mixing chamber foam is created which passes through the orifice outlet, through the outlet chamber and out of the pump outlet.

The single orifice may be in the shape of an elongated slit. The outlet passage may have an orifice plate which defines the orifice. At least two orifices may be defined, including a first orifice defined between the mixing chamber and the outlet chamber, and a second orifice defined near the pump outlet. The two orifices may be in the shape of elongated slits. The two elongated slits may be rotated relative to each other in the flow direction of the foam. The two slits may be perpendicular to each other. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a single orifice in the shape of a slit smaller than said mixing chamber cross sectional area, and at least one outlet chamber in communication with the mixing chamber through said one orifice outlet and in communication with a pump outlet for dispensing foam, whereby when air and fluid is fed into said mixing chamber foam is created which passes through the orifice outlet, through the outlet chamber and out of the pump outlet.

The outlet passage may have an orifice plate which defines the orifice. At least two orifices may be defined, including a first orifice defined between the mixing chamber and the outlet chamber, and a second orifice defined near the pump outlet. The two orifices may be in the shape of elongated slits. The two elongated slits may be rotated relative to each other in the flow direction of the foam. The two slits may be perpendicular to each other. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a plurality of successive orifice plates each defining at least one orifice smaller than said mixing chamber cross sectional area, and a plurality of successive outlet chambers between the mixing chamber and a pump outlet for dispensing foam, whereby when air and fluid is fed into said mixing chamber foam is created which passes through the orifices and outlet chambers and out of the pump outlet.

The orifices may be in the shape of elongated slits. The elongated slits may be rotated relative to each other in the flow direction of the foam. The two elongated slits may be perpendicular to each other. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area, an outlet passage having a plurality of successive orifice plates each defining an elongated slit smaller than said mixing chamber cross sectional area, the orifice plates being oriented along the flow path so that the elongated slits are rotated relative to each other in the flow direction of the foam, and a plurality of successive outlet chambers between the mixing chamber and a pump outlet for dispensing foam, whereby when air and fluid is fed into said mixing chamber foam is created which passes through the orifices and outlet chambers and out of the pump outlet.

The two elongated slits may be perpendicular to each other. The foam pump assembly may further comprise a container for holding a source of liquid.

The invention provides a foam pump assembly for dispensing foam, comprising a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of sub-chambers connected in series to provide a series flow path for the foam, and defining restricted passageways between the adjacent sub-chambers, whereby when air and fluid is fed into said mixing chamber foam is created which passes into the outlet chamber, through the flow path and out of the pump outlet.

The outlet chamber may comprise a plurality of stacked and spaced disks contained in a cylinder which define the flow path. The edges of the disks may have a reduced diameter along at least a portion of the circumference to define a flow path passage between the disk edge and a wall of the outlet chamber. The foam pump assembly may further comprise support members between the disks to support and space the disks. The support members may comprise a pair of support chamber walls which cross each other, and wherein at least one end of one support chamber wall extends to a wall of the outlet chamber. The foam pump assembly may further comprise a container for holding a source of liquid. The foam pump assembly may further comprise a container for holding a source of liquid.

Figure 1A:
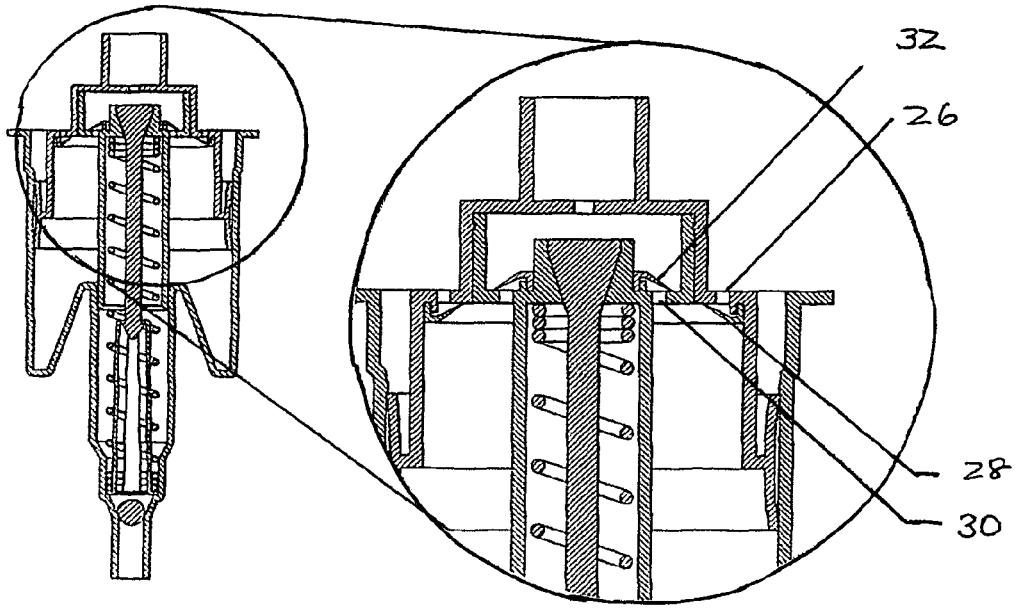
FIG. 1A is an elevation view of an upper part of FIG. 1 to show some part details with greater clarity.

Referring to FIG. 1, the foam pump assembly has 10 a dual piston pump engine capable of simultaneously pumping a liquid and air to create a foam substance. The assembly 10 has an air piston 12, a liquid piston 14, and an air cylinder 16. A liquid cylinder 18 has a liquid inlet port 20, a liquid inlet valve 22 and a liquid outlet valve 24. As shown in FIG. 1A, the air cylinder 16 has an air inlet port 26, an air inlet valve 28, an air outlet port 30 and an air outlet valve 32. The air outlet may or may not have a valve which closes or at least partly closes. As used herein, the term "air outlet" includes both valve and non-valve outlet arrangements.

The liquid inlet valve 22 has inclined walls to form a valve seat and a ball which rests in the valve seat when the valve is closed. A spring 34 biases the air piston 12 to the upper region of the air cylinder 16 when the pump is in a rest state. The pump assembly is attached to a source of fluid, such as a fluid reservoir, and fluid enters the assembly from the bottom as shown in FIG. 1. However, the spatial orientation of the pump assembly and fluid reservoir may be different.

The air outlet port 30 is connected to a mixing chamber 40 to deliver compressed air to the mixing chamber 40 when the pump is actuated. The liquid cylinder 18 is connected to the mixing chamber 40 through the liquid outlet valve 24 and delivers liquid to the mixing chamber 40 when the pump is actuated. The foam exits the mixing chamber 40 at outlet 42.

The air inlet and outlet valves, and the liquid inlet and outlet valves, operate in a conventional manner, in a pump cycle. During a first part of the cycle the air outlet and liquid outlet valves are closed, and the air inlet valve and liquid inlet valves are open so that air and liquid are received in their respective air and liquid chambers. In the next step of the cycle, the air inlet valve and liquid inlet valve are closed. The air piston and liquid piston move to cause a reduction in their interior volumes. The air outlet valve and liquid outlet valve both open, forcing compressed air and liquid under pressure into the mixing chamber to create a foam product. The foam product leaves the mixing chamber by passing through an outlet chamber.

The pump may be actuated by depressing a nozzle or actuator. This drives both the air and liquid pistons into their respective cylinders. As the air piston is traveling, the air intake valve closes and air is compressed inside the air cylinder. The compressed air is forced through the air outlet port passing through air outlet valve to the mixing chamber. As the liquid piston travels into the liquid cylinder, the liquid inlet valve closes and the liquid in the liquid cylinder is pressurized forcing the liquid through the liquid outlet passage passing through the one way liquid outlet valve into the mixing chamber. Both air and liquid are driven into the mixing chamber simultaneously and are commingled to form foam.

When the nozzle or actuator is released, both the air and liquid piston, which are biased by a spring in the liquid chamber, will return to their idle or rest position. The air inlet valve opens allowing the air cylinder to be recharged. Simultaneously, the air outlet valve closes to prevent foam material in the mixing chamber to enter the air cylinder. At the same time, the liquid outlet valve closes allowing a vacuum to form in the liquid cylinder which in turn allows the liquid inlet valve to open allowing liquid to be drawn into the liquid cylinder from the liquid reservoir. The pistons are left in an idle position until actuated again by pressing the nozzle or actuator.

The outlet chamber may be formed according to at least two different versions or embodiments, and two of them will be described. In both embodiments, an outlet chamber is located after the mixing chamber.

In a first embodiment, according to FIGS. 2-7, after the mixing chamber, the foam passes through an outlet chamber 50 having a sinuous, curving flow path. The outlet chamber provides a single series flow path, whereby the foam flows along in a single path or passageway, but makes turns along that passageway. When the foam follows this single passageway and makes turns, the quality of the foam is enhanced. The passageway may be sinuous or curving. The flow path may be through restricted openings or ports (in series) having relatively small cross-sectional areas, and between successive openings pass through larger volumes having larger cross-sectional areas. The foam may thus pass through a restricted opening, orifice or slot, then through a larger space, then through another restricted opening, orifice or slot and then through a larger space. The number of restricted openings, orifices and slots along the path, as well as the number of larger volume spaces along the path may be different depending on the particular application or desired properties of the foam sought. The size and configuration of the restricted openings, orifices or slots may change, and the size of the larger volume spaces may also change.

Figure 3:
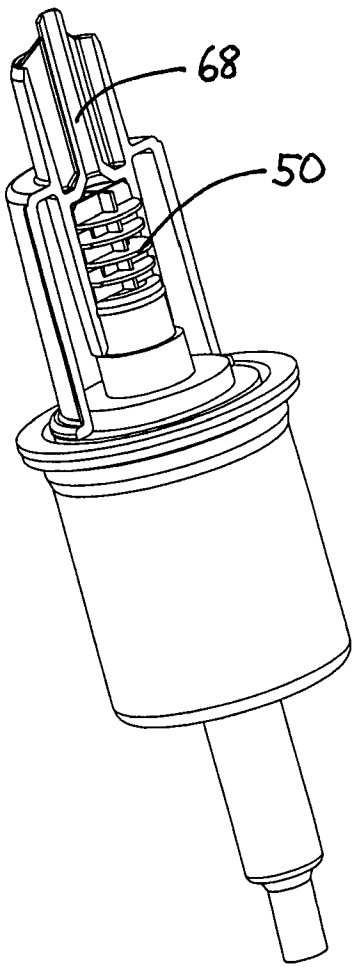
FIG. 3 is a perspective view of the same embodiment of FIG. 2.
Figure 2:
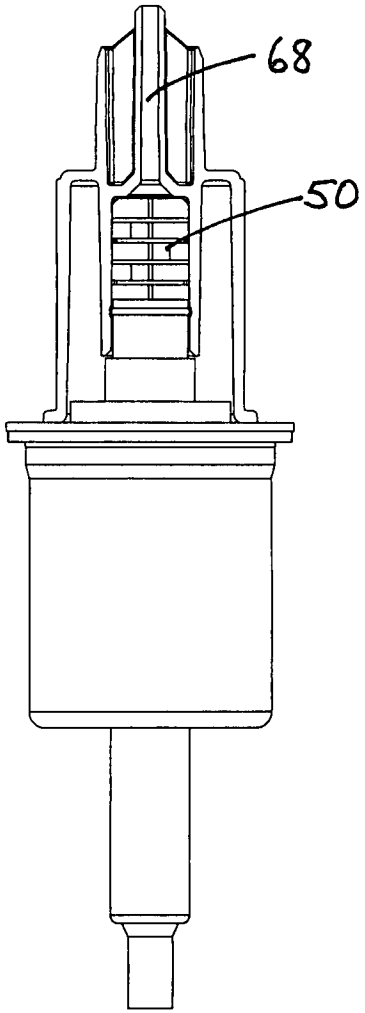
FIG. 2 is an elevation view, in partial cross section, of a foam pump assembly with an outlet chamber according to one embodiment of the invention.
Figure 7:
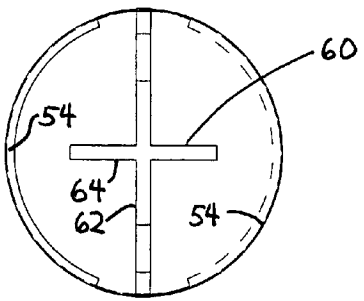
FIG. 7 is a top view of the outlet chamber insert of FIGS. 4, 5 and 6.

The outlet chamber 50 comprises a parallel array of stacked circular disks 52*a*, 52*b*, 52*c* and 52*d* (generically 52) spaced vertically from each other. Each disk 52 has generally the same diameter and fits within a cylinder as shown in FIGS. 2 and 3. However, each disk 52 has an edge slot or reduced diameter portion 54 along part of its circumference, which part may be about 135 degrees along its circumference. The angular extent of this reduced diameter portions or edge slot, or the amount of reduction of the diameter may vary depending on different applications and desired performance of the pump. The disks 52 are arranged vertically as shown in FIGS. 5-7 so that the reduced diameter portion or edge slot of each disk is positioned about 180 degrees out of position from its immediately neighboring disks in the stack.

The flow path of the foam through the stacked circular disks follows a generally curved, sinuous and circular spiral path as the foam proceeds up and around the disks near the reduced diameter portions, making turns as it travels along the path.

The disks 52 are separated and supported by support members 60*a*, 60*b*, 60*c*, 60*d* and 60*e* (generically 60) which keep the disks 52 spaced and supported. The support members 60 comprise two generally perpendicular walls 62, 64, each wall extending across the disk. One wall of intermediate support members 60*b*, 60*c*, and 60*d* have one of its ends extending entirely to the disk edge to stop foam from passing around it, while the other end of this same wall, and the two ends of the other wall do not extend to the disk edge to allow the foam to pass around the ends of these walls. The walls of bottom and top support members 60*a* and 60*e* have one wall whose ends extend entirely to the edge of the disk.

Figure 4:
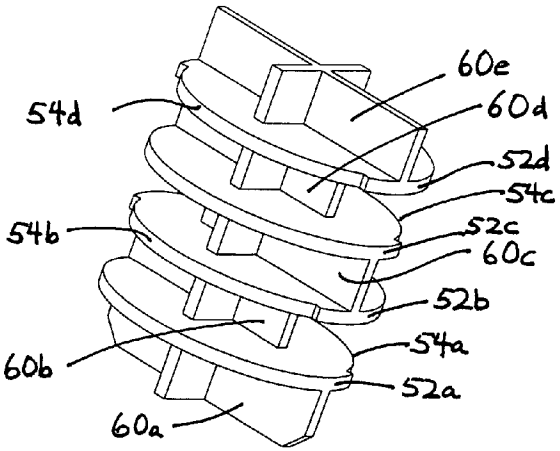
FIG. 4 is a perspective view of an outlet chamber insert according to the first embodiment.
Figure 5:
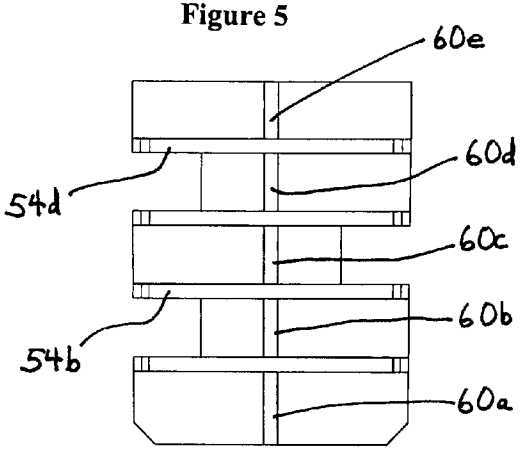
FIG. 5 is a side elevation view of the outlet chamber insert of FIG. 4.
Figure 6:
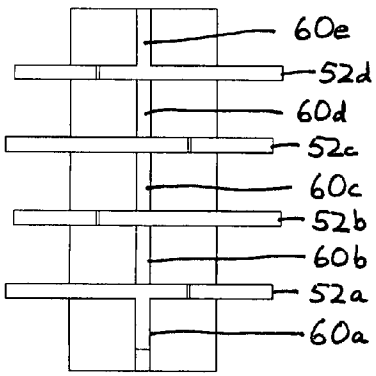
FIG. 6 is a front elevation view of the outlet chamber insert of FIGS. 4 and 5.

As shown in FIGS. 4, 5 and 6, the foam (comprised of liquid and air bubbles) will enter the stack of disks from the bottom and will be allowed to pass only through the reduced diameter portion or edge slot 54 of each disk level, and will be allowed to pass only around the ends of the perpendicular walls which do not extend entirely to the disk edges, as the foam passes from the bottom to the top of the arrangement shown in these Figures. The foam will exit the assembly top through an outlet passage or nozzle 68 as shown in FIGS. 2 and 3.

Described in another way, the outlet chamber according to FIGS. 4, 5 and 6 provides a plurality of sub-chambers, each sub-chamber being defined between adjacent horizontal disks. One sub-chamber is defined between disks 52*a* and 52*b*, another between disks 52*b* and 52*c*, and another between 52*c* and 52*d*. The sub-chambers are connected in series to provide a series flow path from bottom to top. Between adjacent horizontal disks, the flow path is restricted or smaller in cross-sectional area by the circumferential slots 54 on the perimeter of the disks, which slots define restricted openings between the sub-chambers. Accordingly, the foam passes through in series each sub-chamber having a relatively large cross-sectional area and volume, and then through a restricted opening, orifice or slots, then through another sub-chamber, and then through another restricted opening. The number of restricted openings as well as the number of sub-chambers may vary depending on the application. To describe the arrangement in another way, the foam passes through in series sub-chambers having a defined cross-sectional area, and between sub-chambers passes through restricted passages or openings having smaller cross-sectional areas than the sub-chambers.

Figure 8:
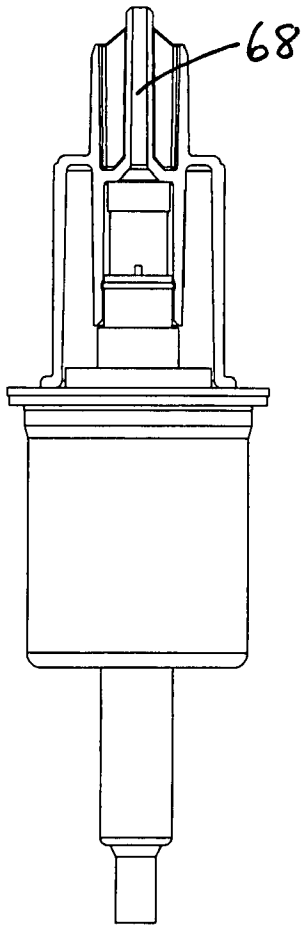
FIG. 8 is a perspective view of a foam pump assembly with a second embodiment of an outlet chamber.
Figure 10:
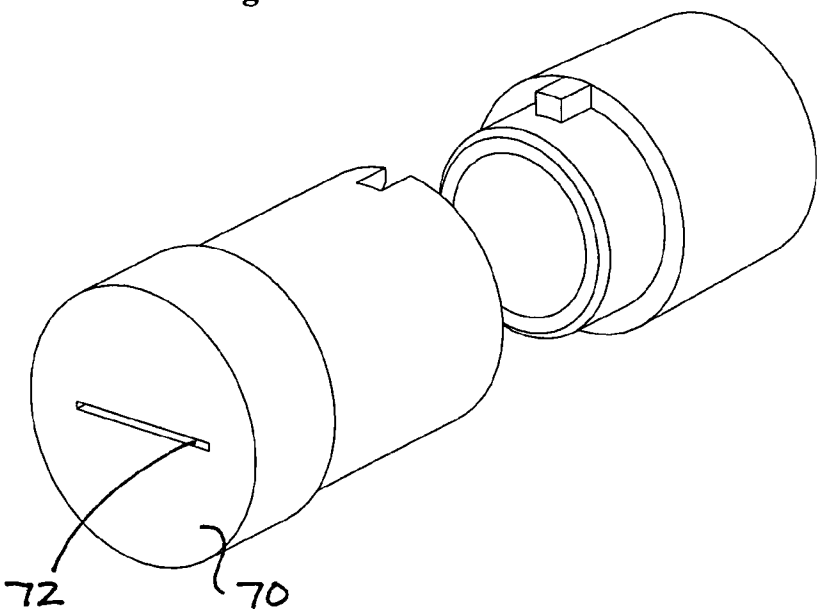
FIG. 10 is an exploded view of the outlet chamber embodiment of FIG. 9.
Figure 9:
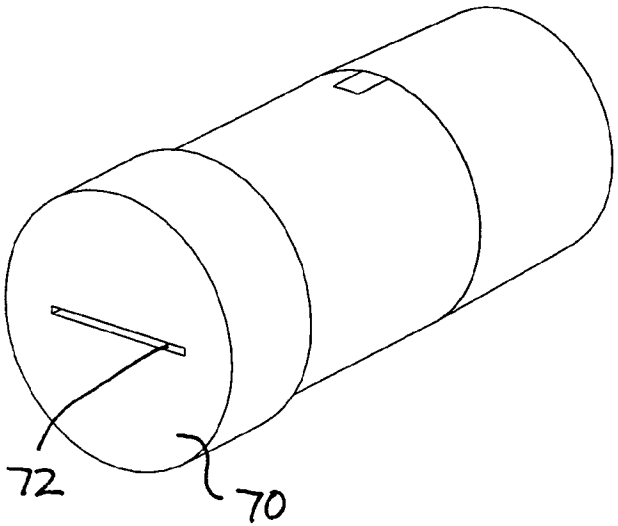
FIG. 9 is a perspective view of the outlet chamber of FIG. 8.

Shown in FIGS. 8, 9 and 10 is another embodiment of an outlet chamber connected to the outlet of the mixing chamber which has at least one orifice plates 70. The orifice plate 70 forms a bulkhead with a single opening in the form of a rectangular orifice or a slit 72. The assembly of orifice plates and outlet chambers are connected to a nozzle dispensing the foam product.

When the foam exits the mixing chamber it passes through at least one orifice plate 70 whose rectangular orifice slit 72 is dimensioned in such a way as to reduce the size of the bubbles in the foam. The orifice slit is smaller than the cross-sectional area of the mixing chamber. Passage of the foam through the orifice plate slit 72 serves to further homogenize the foam.

Although one orifice plate 70 is shown, a plurality of orifice plates spaced from each other may be provided, so the foam passes through a successive number of orifice plates each with its own slit or orifice, and between the orifice plates the cross-sectional area of the passageway increases. The quality and consistency of the foam is determined by the sizes of the orifices and the number of orifice plates the foam passes through. The size and configuration of the orifices may be changed for a particular application or type of foam product. The configuration of the orifice may be an elongated slit, a round hole, an elongated rounded hole such as oval or ellipse, or another shape if desired. The shape can be a triangle or other multi-sided polygon, with sharp and/or rounded vertices. The orifice shape may be a cross with two intersecting slits, or more than two intersecting slits. The orifice may have a complex rounded shape, including a composite of two, three or more circles which partially overlap, for example. Each plate may have more than one slit or hole which does not intersect or overlap with other slits or holes.

If multiple plates are provided in succession, the slits on successive plates may be rotated relative to each other which may create a swirling or rotating foam flow through the successive slits and outlet chambers. The rotation from plate to plate may be gradual, such as 10°, 20° or 30° for example, or may be as much as 90° (that is, perpendicular). The rotation of the plates may provide better homogeneity of the foam. The foam product exits the last orifice plate into the nozzle and is expelled from the pump at the pump outlet.

It may be desirable to provide air and/or liquid at additional locations along the flow path after where the air and liquid meet in the mixing chamber. For example, air could be provided at one or more places in the outlet chamber after the mixing chamber.

The foam pump assemblies may be provided with a source of fluid in a collapsible or non-collapsible form. If non-collapsible, the container may have a removable plug to provide venting. The foam pump assemblies may also be provided in a housing or dispenser in which a source of fluid in a collapsible or non-collapsible container may be received. The foam pump assembly may be connected with the fluid containers using keyed systems, one of which is disclosed in applicant's co-pending application U.S. Ser. No. 11/803,949, filed May 16, 2007, which is incorporated by reference herein.

While an embodiment of a foam pump assembly with two versions of an outlet chamber have been disclosed, the invention is not limited to these embodiments, and variations may be made as occur to those skilled in the art. The scope of the invention shall be defined only by way of the following claims.

I claim:

1. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks with support members between the disks which cross each other providing a flow path with successive turns, whereby when air and fluid is fed into said mixing chamber foam is created which passes into the outlet chamber, through the flow path and out of the pump outlet.

2. The foam pump assembly according to claim 1, wherein the edges of the disks have a reduced diameter along at least a portion of the circumference to define a flow path passage between the disk edge and a wall of the outlet chamber.

3. The foam pump assembly according to claim 1, wherein at least one end of one support chamber wall extends to a wall of the outlet chamber.

4. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks contained in a cylinder with support members between the disks which cross each other to define a flow path with successive turns, whereby when air and fluid is fed into said mixing chamber foam is created which passes into the outlet chamber, through the flow path and out of the pump outlet.

5. The foam pump assembly according to claim 4, wherein the edges of the disks have a reduced diameter along at least a portion of the circumference to define a flow path passage between the disk edge and a wall of the outlet chamber.

6. The foam pump assembly according to claim 4, wherein at least one end of one support member extends to a wall of the outlet chamber.

7. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks contained in a cylinder with support members between the disks which cross each other, wherein the edges of the disks have a reduced diameter along at least a portion of the circumference to define a flow path passage between the disk edge and a wall of the outlet chamber to define a flow path with successive turns, whereby when air and fluid is fed into said mixing chamber foam is created which passes into the outlet chamber, through the flow path and out of the pump outlet, wherein the edges of the disks have a reduced diameter along at least a portion of the circumference to define a flow path passage between the disk edge and a wall of the outlet chamber.

8. The foam pump assembly according to claim 7, wherein at least one end of one support member extends to a wall of the outlet chamber.

9. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber providing a flow path with successive turns, wherein the outlet chamber comprises a plurality of stacked and spaced disks contained in a cylinder with support members between the disks which cross each other which define the flow path, wherein the edges of the disks have a reduced diameter along at least a portion of the circumference to define a flow path passage between the disk edge and a wall of the outlet chamber, wherein support members are provided between the disks to support and space the disks, wherein the support members comprise a pair of support chamber walls which cross each other, and wherein at least one end of one support chamber wall extends to a wall of the outlet chamber, whereby when air and fluid is fed into said mixing chamber foam is created which passes into the outlet chamber, through the flow path and out of the pump outlet.

10. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area and a plurality of stacked and spaced disks with support members between the disks which cross each other, an outlet passage having a single orifice smaller than said mixing chamber cross sectional area, and at least one outlet chamber in communication with the mixing chamber through said one orifice outlet and in communication with a pump outlet for dispensing foam, whereby when air and fluid is fed into said mixing chamber foam is created which passes through the orifice outlet, through the outlet chamber and out of the pump outlet.

11. The foam pump assembly according to claim 10, further comprising a container for holding a source of liquid.

12. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having an air inlet valve and an air outlet, a mixing chamber in communication with the liquid cylinder through the liquid outlet valve for receiving liquid, and in communication with the air cylinder through the air outlet for receiving air, the mixing chamber having a defined cross sectional axial area and a plurality of stacked and spaced disks with support members between the disks which cross each other, an outlet passage having a plurality of successive orifice plates each defining at least one orifice smaller than said mixing chamber cross sectional area, and a plurality of successive outlet chambers between the mixing chamber and a pump outlet for dispensing foam, whereby when air and fluid is fed into said mixing chamber foam is created which passes through the orifices and outlet chambers and out of the pump outlet.

13. A foam pump assembly for dispensing foam, comprising:

a dual piston pump engine having an air cylinder and fluid cylinder, said cylinders having an air piston and a liquid piston, respectively, said liquid cylinder having a liquid inlet valve and a liquid outlet valve, said air cylinder having air inlet valve and an air outlet, a mixing chamber in communication with the liquid cylinder through the liquid outlet valve for receiving liquid, and in communication with the air cylinder through the air outlet for receiving air, an outlet chamber in communication with the mixing chamber and in communication with a pump outlet for dispensing foam, said outlet chamber comprising a plurality of stacked and spaced disks with support members between the disks which cross each other to define a plurality of sub-chambers connected in series to provide a series flow path for the foam, and defining restricted passageways between the adjacent sub-chambers, whereby when air and fluid is fed into said mixing chamber foam is created which passes into the outlet chamber, through the flow path and out of the pump outlet.

14. The foam pump assembly according to claim 13, wherein the edges of the disks have a reduced diameter along at least a portion of the circumference to define a flow path passage between the disk edge and a wall of the outlet chamber.

15. The foam pump assembly according to claim 13, wherein at least one end of one support chamber wall extends to a wall of the outlet chamber.

16. The foam pump assembly according to claim 1, further comprising a container for holding a source of liquid.

17. The foam pump assembly, according to claim 4, further comprising a container for holding a source of liquid.

18. The foam pump assembly according to claim 7, further comprising a container for holding a source of liquid.

19. The foam pump assembly according to claim 9, further comprising a container for holding a source of liquid.

20. The foam pump assembly according to claim 13, further comprising a container for holding a source of liquid.

* * * * *